US009399354B2

(12) United States Patent
Numata et al.

(10) Patent No.: US 9,399,354 B2
(45) Date of Patent: Jul. 26, 2016

(54) TREATMENT-LIQUID APPLICATION APPARATUS AND IMAGE FORMING SYSTEM INCORPORATING SAME

(71) Applicants: Hironori Numata, Ibaraki (JP); Yasushi Hashimoto, Ibaraki (JP)

(72) Inventors: Hironori Numata, Ibaraki (JP); Yasushi Hashimoto, Ibaraki (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/840,773

(22) Filed: Aug. 31, 2015

(65) Prior Publication Data

US 2016/0059586 A1 Mar. 3, 2016

(30) Foreign Application Priority Data

Sep. 3, 2014 (JP) ..... 2014-179452

(51) Int. Cl.
*B41J 2/21* (2006.01)
*B41J 2/14* (2006.01)
*B41J 11/00* (2006.01)

(52) U.S. Cl.
CPC *B41J 2/2114* (2013.01); *B41J 2/14* (2013.01); *B41J 11/0015* (2013.01); *B41J 2202/02* (2013.01)

(58) Field of Classification Search
CPC ..... B41J 2202/02; B41J 2/14; B41J 2/04; B41J 2/211; B41J 2/2114
USPC ..... 347/21
See application file for complete search history.

(56) References Cited

U.S. PATENT DOCUMENTS 5,794,091 A * 8/1998 Verlinden ..... G03D 3/132 396/612
2013/0106946 A1 5/2013 Sunaoshi et al.
2014/0253652 A1* 9/2014 Ohba ..... B41J 11/0015 347/101
2015/0015636 A1 1/2015 Kuwana et al.
2015/0022600 A1 1/2015 Numata
2015/0210091 A1 7/2015 Hoshina et al.

FOREIGN PATENT DOCUMENTS

JP 2001-001490 1/2001
JP 2013-091260 5/2013
JP 2013-091261 5/2013
JP 2013-091262 5/2013
JP 2014-198458 10/2014

* cited by examiner

*Primary Examiner* — Manish S Shah
*Assistant Examiner* — Yaovi M Ameh
(74) *Attorney, Agent, or Firm* — Cooper & Dunham LLP

(57) ABSTRACT

A treatment-liquid application apparatus includes a rotary treatment-liquid applicator, a rotary treatment-liquid supplier, a transfer rotator, and a contact load adjuster. The contact load adjuster adjusts a contact load of the rotary treatment-liquid supplier on the treatment-liquid applicator. After feeding of a recording medium is initiated by contact between the treatment-liquid applicator and the transfer rotator, an acceleration time until a feed speed of the recording medium reaches a constant speed during printing is set. Before feeding of the recording medium is initiated, the rotary treatment-liquid supplier contacts the treatment-liquid applicator and imparts a contact load L0. During an acceleration operation of the recording medium after feeding of the recording medium is initiated, the transfer rotator contacts the treatment-liquid applicator via the recording medium and imparts a contact load L1, and the contact load adjuster adjusts the contact load L1 to be greater than the contact load L0.

7 Claims, 7 Drawing Sheets

TREATMENT-LIQUID APPLICATION APPARATUS AND IMAGE FORMING SYSTEM INCORPORATING SAME

CROSS-REFERENCE TO RELATED APPLICATIONS

This patent application is based on and claims priority pursuant to 35 U.S.C. §119(a) to Japanese Patent Application No. 2014-179452, filed on Sep. 3, 2014, in the Japan Patent Office, the entire disclosure of which is incorporated by reference herein.

BACKGROUND

1. Technical Field

Aspects of the present disclosure relate to a treatment-liquid application apparatus and an image forming system, and more specifically relate to a treatment-liquid application apparatus that applies a treatment liquid for suppressing ink bleeding to a long recording medium supplied to a printing apparatus including an inkjet recording apparatus and the like, and an image forming system incorporating the treatment-liquid application apparatus.

2. Description of the Related Art

An image forming system or a treatment agent liquid application apparatus is known to include a treatment agent liquid application apparatus between a paper feeding apparatus that feeds a recording medium and an inkjet printer in order to apply a treatment agent liquid (also referred to as "treatment liquid") before discharging ink onto the recording medium to suppress bleeding of an ink image and enhance the image quality. In such a configuration, the treatment agent liquid application apparatus includes an application unit to apply a treatment liquid onto a recording medium, such as a long continuous sheet or a continuous-form sheet, to suppress bleeding of an ink image and enhance the image quality.

SUMMARY

In an aspect of the present disclosure, there is provided a treatment-liquid application apparatus that includes a rotary treatment-liquid applicator, a rotary treatment-liquid supplier, a transfer rotator, and a contact load adjuster. The rotary treatment-liquid applicator is disposed on a feed path of a long recording medium to apply a treatment liquid measured to the recording medium. The rotary treatment-liquid supplier is disposed below the rotary treatment-liquid applicator to contact and retract from the rotary treatment-liquid applicator, scoop up the treatment liquid, and supply the treatment liquid to the rotary treatment-liquid applicator. The transfer rotator is disposed above the rotary treatment-liquid applicator to contact and retract from the rotary treatment-liquid applicator via the recording medium and transfer the treatment liquid measured on the rotary treatment-liquid applicator to the recording medium in contact with the rotary treatment-liquid applicator. The contact load adjuster adjusts a contact load of the rotary treatment-liquid supplier on the rotary treatment-liquid applicator. After feeding of the recording medium is initiated by contact between the rotary treatment-liquid applicator and the transfer rotator, an acceleration time until a feed speed of the recording medium reaches a constant speed during printing is set. Before feeding of the recording medium is initiated, the rotary treatment-liquid supplier contacts the rotary treatment-liquid applicator and imparts a contact load L0. During an acceleration operation of the recording medium after feeding of the recording medium is initiated, the transfer rotator contacts the rotary treatment-liquid applicator via the recording medium and imparts a contact load L1, and the contact load adjuster adjusts the contact load L1 to be greater than the contact load L0.

In an aspect of the present disclosure, there is provided an image forming system that includes the treatment-liquid application apparatus to apply the treatment liquid to the recording medium before formation of an image, and an inkjet recording apparatus to discharge ink droplets onto the recording medium on which the treatment liquid has been applied, to form an image, the inkjet recording apparatus disposed on a downstream side of the treatment-liquid application apparatus in the feed direction.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
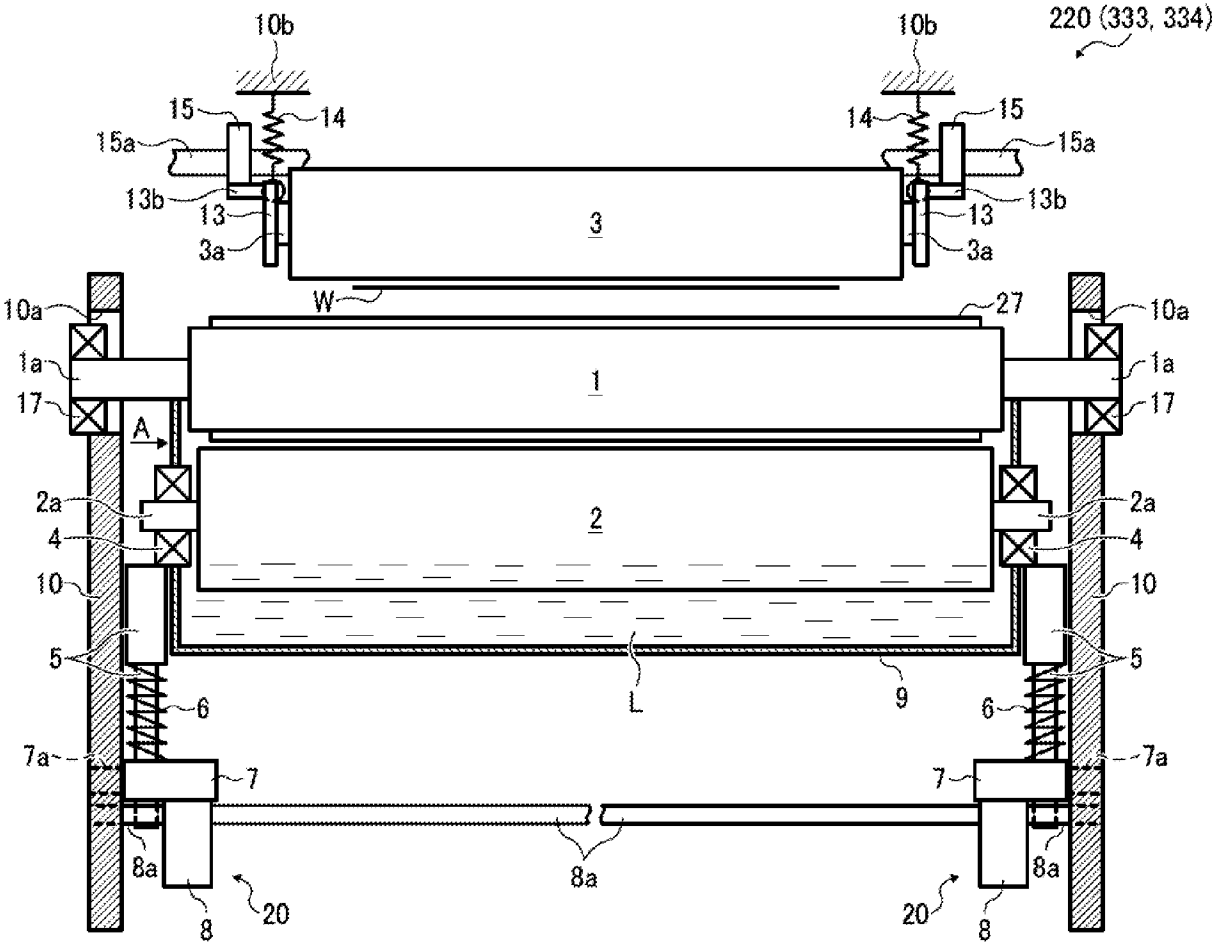
FIG. 1 is a schematic partially sectional front view of a treatment-liquid application apparatus according to Embodiment 1 when viewed from a front side.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

In a treatment agent liquid application apparatus (hereinafter, a treatment agent liquid will be referred to as a "treatment liquid", and a treatment agent liquid application apparatus will be referred to as a "treatment-liquid application apparatus"), an application unit includes, for example, a squeeze roller, an application roller, and a pressure roller (hereinafter referred to as a "transfer roller"). The squeeze roller has a function to scoop up the treatment liquid, and is configured so as to be capable of contacting the application roller and retracting from the application roller (hereinafter, this contacting and retracting may also be written to as "contacting/retracting"). The application roller has a function to measure an amount of liquid flow through by contact from the squeeze roller, and to maintain the measured treatment liquid on the surface and feed it to the location of a recording medium. The transfer roller sandwiches the recording medium between itself and the application roller, and is capable of contacting/retracting to/from the application roller. The transfer roller transfers the measured treatment liquid on the surface of the application roller to the recording medium when the transfer roller contacts the application roller.

When directly applying the treatment liquid to the recording medium, the recording medium is present between the application roller and the transfer roller, and thus the following problems occur when the transfer roller contacts the application roller in a state in which the recording medium is stopped. (1) During start up (acceleration), the tracking of a recording-medium feed driver and an application-roller driver easily becomes unstable, and if feeding is initiated in this state, tension fluctuations may occur in the recording medium which worsens the feeding of the recording medium. (2) The recording medium may adhere to the surface of the application roller due to the viscosity of the treatment liquid residing on the surface of the application roller, which causes the recording medium to wind around the application roller and jam. (3) The strength of the recording medium may be degraded by treatment liquid that has permeated into or been transferred onto the recording medium due to the passage of time during contact, and the recording medium may break or jam if tension is applied to a portion where the strength has degraded during feeding of the recording medium.

In order to overcome the problems described in (1) to (3) above, it is necessary to contact and rotate the squeeze roller and the application roller before beginning feeding of the recording medium and to contact the transfer roller to the application roller after beginning feeding of the recording medium in order to form a nip. However, in this operation, two types of states occur: contact of the transfer roller and retraction of the transfer roller. Therefore, during retraction of the transfer roller, a contact load distribution difference is generated, in which there is a difference between the maximum value and minimum value of the contact load per unit length in the longitudinal direction of the application roller and the squeeze roller due to bending of the application roller, and this leads to a collapse in the nip balance.

Rotation of the application roller in a state in which the nip balance has collapsed causes the measured amount of treatment liquid at an area where the load has decreased due to bending of the application roller to become excessive, and this treatment liquid adheres to the surface of the application roller. If the transfer roller contacts the application roller in this state to press the recording medium between the application roller and the transfer roller, the following defects/problems may occur.

(If the Permeability of the Recording Medium is Poor)

The following problems may occur in the case of a recording medium with poor permeability such as gloss coated paper. (1) The excessive treatment liquid on the surface of the application roller is applied to the sheet while being spread out between the sheet and the application roller, forming an excessive application portion across a range of, for example, 4 m or more in the recording-medium feed direction. A difference in glossiness during image printing appears in this excessive application portion occurs compared to portions where the treatment liquid is normally applied, and this is not suitable for printing and thus becomes waste paper (discarded paper) which leads to increases in waste paper. (2) When the excessive application portion contacts a roller disposed downstream, roller staining is accelerated and this dramatically shortens the cleaning cycle. (3) Further, the amount of treatment liquid that is consumed also increases due to unnecessary application of the treatment liquid.

(If the Permeability of the Recording Medium is Good)

The following problems may occur in the case of a recording medium with good permeability such as plain paper (PPC). (1) Excessive treatment liquid on the surface of the application roller may permeate into the sheet at a starting point. Since excessive treatment liquid permeates into the sheet, the rigidity of the sheet decreases, which is regarded as a starting point, the sheet may tear. The other problems are similar to those described above in the case of a recording medium with poor permeability.

If the diameter of the application roller is increased in order to prevent the bending of the application roller, the amount of treatment liquid that flows through the measurement unit may increase, and thus an accurate amount of application cannot be obtained.

According to the treatment-liquid application apparatus of at least one embodiment of the present disclosure, in the contact/retraction state of the transfer roller to/from the application roller, the contact load distribution between the application roller and the squeeze roller can be equalized so that a uniform application state can be obtained from immediately after the start of the treatment liquid application operation.

Embodiments of the present disclosure will now be described in detail below referring to the drawings. In the explanation of the conventional technology and the embodiments and the like, the same reference codes are allocated to elements (members or components) having the same function and shape or the like after the first explanation thereof, and redundant descriptions are omitted below unless there is a need to avoid confusion.

Figure 6:
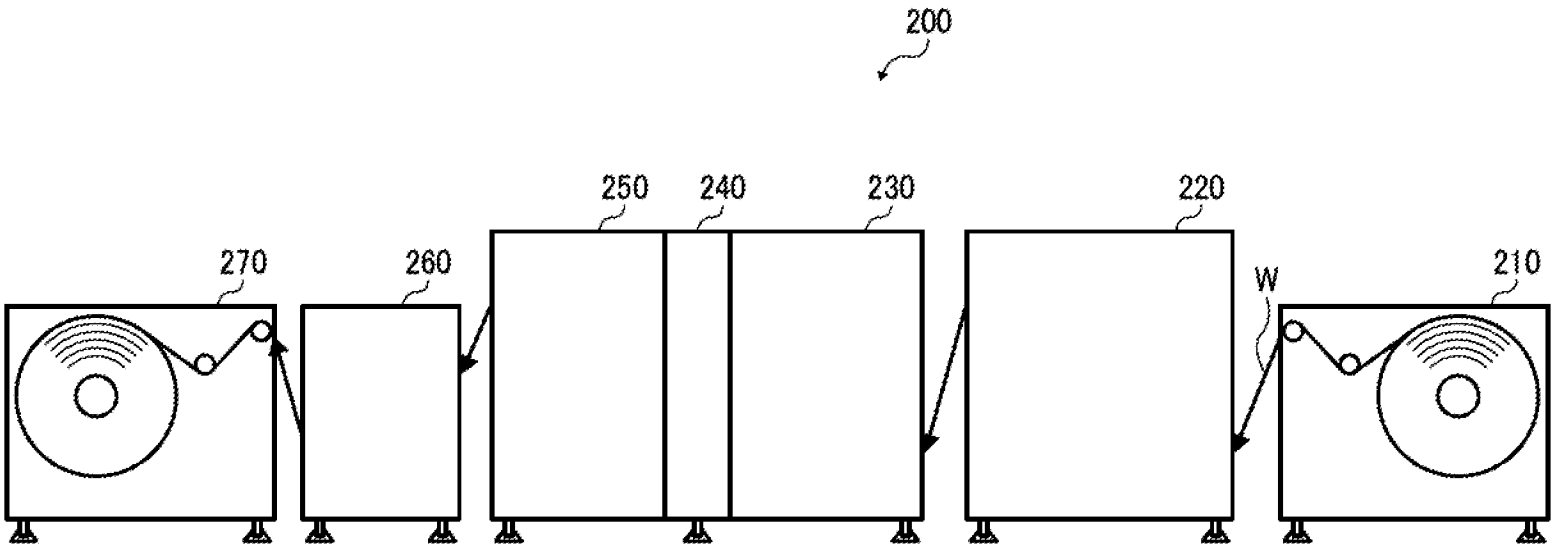
FIG. 6 is a schematic structural view illustrating the overall structure of an image forming system equipped with the treatment-liquid application apparatus according to an embodiment.

First, referring to FIG. 6, the overall structure of a printing system 200 will be explained as one example of an image forming system equipped with a treatment-liquid application apparatus according to an embodiment of the present disclosure. FIG. 6 is a schematic structural view illustrating the overall structure of an image forming system equipped with the treatment-liquid application apparatus according to the embodiment. As shown in FIG. 6, the printing system 200 includes the following in order from upstream to downstream in the recording-medium feed direction: a sheet feeder 210, a treatment-liquid application apparatus 220, a first inkjet printer 230, a reversing apparatus 240, a second inkjet printer 250, a post-printing drying apparatus 260, and a reeler 270. The sheet feeder 210 is provided so that it can feed a recording medium W (hereinafter may also be referred to simply as a "sheet") such as a long, continuous rolled sheet or continuous-form sheet. The recording medium W that has been fed from the sheet feeder 210 is then first supplied to the treatment-liquid application apparatus 220 that is adjacent thereto on the left.

The treatment-liquid application apparatus 220 applies a treatment liquid for enhancing the image quality, such as by preventing bleeding of the ink, suppressing show-through, assisting permeation, and the like, to a front side, rear side, or both sides of the recording medium W. As will be described below, the treatment-liquid application apparatus 220 includes devices for applying the treatment liquid to the recording medium W and then drying the recording medium W to which the treatment liquid has been applied. The first inkjet printer 230 discharges ink droplets onto the front side of the recording medium W to which the treatment liquid was applied in the treatment-liquid application apparatus 220 to form a desired image.

The reversing apparatus 240 includes a dryer, and dries an image on the front side of the recording medium W formed by the first inkjet printer 230 and then reverses the front and rear sides of the recording medium W. The second inkjet printer 250 discharges ink droplets onto the front side (the rear side before reversal) of the recording medium W after the front and rear sides have been reversed by the reversing apparatus 240 to form a desired image. The post-printing drying apparatus 260 dries the recording medium W on which images have been formed on both sides thereof with hot air or the like from a dryer. The reeler 270 reels the dried recording medium W.

The sheet feeder 210 and the treatment-liquid application apparatus 220, the treatment-liquid application apparatus 220 and the first inkjet printer 230, the first inkjet printer 230 and the reversing apparatus 240, the reversing apparatus 240 and the second inkjet printer 250, the second inkjet printer 250 and the post-printing drying apparatus 260, and the post-printing drying apparatus 260 and the reeler 270 are connected by I/F cables. The entire printing system 200 is controlled/managed by a print controller disposed appropriately in the first inkjet printer 230 or the second inkjet printer 250.

As described above, in the present embodiment, the treatment-liquid application apparatus 220 is disposed upstream of the first inkjet printer 230 and the second inkjet printer 250 in the recording-medium feed direction, and thus the treatment liquid is applied in advance to the recording medium W to be printed. Because of that, according to the present embodiment, ink bleeding and the like can be suppressed during printing to achieve high image quality.

Figure 7:
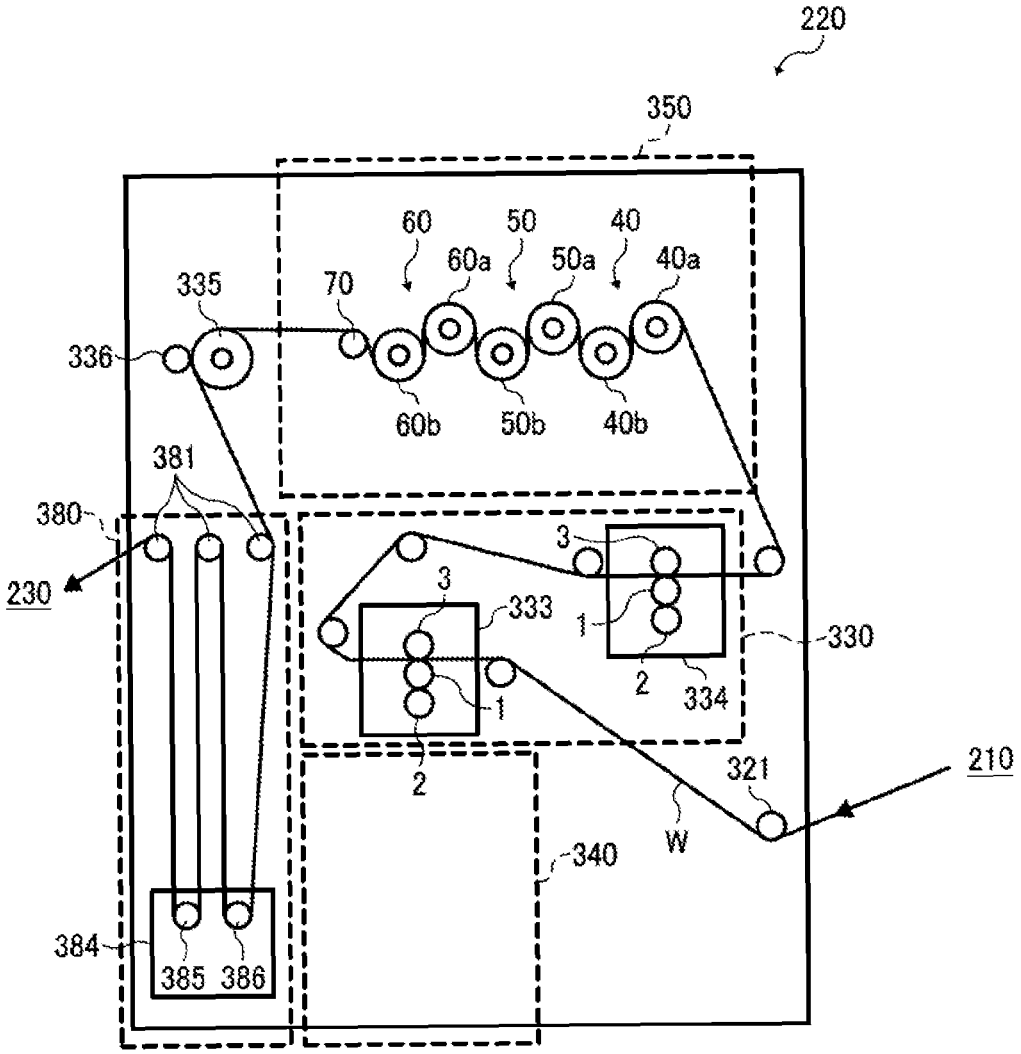
FIG. 7 is an overall structural view of the treatment-liquid application apparatus according to an embodiment.

Referring to FIG. 7, the overall structure and operation of the treatment-liquid application apparatus according to the embodiment will be explained. FIG. 7 is an overall structural view of the treatment-liquid application apparatus according to the embodiment. The treatment-liquid application apparatus 220 includes a treatment liquid application unit 330, a supply unit 340, a drying unit 350, and a dancer unit 380. The recording medium W that has been fed from the sheet feeder 210 is introduced by a guide roller 321 within the treatment-liquid application apparatus 220. An appropriate tension is imparted by the sheet feeder 210 to the recording medium W that is fed via the guide roller 321.

Once the recording medium W has entered the treatment-liquid application apparatus 220, it is fed by an outfeed roller 335 that is driven to rotate by a drive motor. The outfeed roller 335 imparts a feeding force to the recording medium W that is pressed to the outer peripheral surface of the outfeed roller 335 by a feed nip roller 336.

Treatment liquid is applied to the rear side (one side) of the recording medium W that is fed by the outfeed roller 335 in a rear side application unit 333 including a squeeze roller 2, an application roller 1, and a transfer roller 3. After the recording medium W has passed through the rear side application unit 333, treatment liquid is applied to the front side (other side) of the recording medium W in a front side application unit 334 including a squeeze roller 2, an application roller 1, and a transfer roller 3. After the recording medium W has passed through the front side application unit 334, it is fed to a drying unit 350 by the outfeed roller 335 that is driven to rotate and the feed nip roller 336 that is rotated following the outfeed roller 335. The rear side application unit 333 and the front side application unit 334 are both operated selectively, and treatment liquid is applied to the front side or the rear side or both sides of the recording medium W. The supply unit 340 stores the treatment liquid and supplies the treatment liquid to the rear side application unit 333 and the front side application unit 334 as necessary.

The recording medium W to which the treatment liquid has been applied on the front side or the rear side or both sides is heated and dried in the drying unit 350. The drying unit 350 includes the following aligned in order from upstream to downstream in the feed direction along the feed path of the recording medium W: a first-step heating roller set 40, a second-step heating roller set 50, a third-step heating roller set 60, and a discharge feed roller 70. The first-step heating roller set 40 includes a first-step rear side heating roller 40*a* and a first-step front side heating roller 40*b*. The second-step heating roller set 50 includes a second-step rear side heating roller 50*a* and a second-step front side heating roller 50*b*. The third-step heating roller set 60 includes a third-step rear side heating roller 60*a* and a third-step front side heating roller 60*b*. The heating rollers 40*a*, 40*b*, 50*a*, 50*b*, 60*a*, and 60*b* are driven rollers that do not have a drive source, and are rotatably supported by bearings at both ends in the longitudinal direction orthogonal to the sheet surface.

The first-step rear side heating roller 40*a* and the first-step front side heating roller 40*b*, the second-step rear side heating roller 50*a* and the second-step front side heating roller 50*b*, and the third-step rear side heating roller 60*a* and the third-step front side heating roller 60*b* are spaced apart from each other and arranged in a staggered pattern. For example, a line connecting the rotation centers of the first-step rear side heating roller 40*a*, the second-step rear side heating roller 50*a*, and the third-step rear side heating roller 60*a* is arranged to be parallel to and spaced apart from a line connecting the rotation centers of the first-step front side heating roller 40*b*, the second-step front side heating roller 50*b*, and the third-step front side heating roller 60*b*.

After passing through the drying unit 350, the recording medium W is sandwiched and fed by the outfeed roller 335 that is driven by a drive motor and the feed nip roller 336. A plurality of feed nip rollers 336 are disposed along the axial direction of the outfeed roller 335, and these feed nip rollers 336 are pressed to the outer peripheral surface of the outfeed roller 335 by a spring (compression) serving as an elastic biasing unit provided between the apparatus body and the shaft of the feed nip rollers 336.

The recording medium W that has passed between the outfeed roller 335 and the feed nip rollers 336 is fed to the dancer unit 380. The dancer unit 380 includes three guide rollers 381, a movable frame 384 that can move in the vertical direction, a position detector that detects the position of the movable frame 384, and two dancer rollers 385 and 386 that are rotatably attached to the movable frame 384. The movable frame 384 has a weight, and can move in the vertical direction which is the direction of gravity. In the dancer unit 380, the recording medium W is wound around the three guide rollers 381 and the two dancer rollers 385 and 386 in a W-shape.

During feeding of the recording medium W, a controller provided to the treatment-liquid application apparatus 220 controls the rotational driving of the outfeed roller 335 based on an output of the position detector, thereby adjusts the position in the up-down direction of the movable frame 384. In other words, during feeding of the recording medium W, the outfeed roller 335 is acceleration controlled by the controller so as to maintain the height (position at the bottom end of the movable frame 384) of the dancer rollers 385 and 386 in a preset control line. If the dancer rollers 385 and 386 are driven in a downward direction, they act to impart a suspending tension to the recording medium W between the outfeed roller 335 of the treatment-liquid application apparatus 220 and the first inkjet printer 230. This tension can be changed by adjusting weights which can be attached to and detached from the dancer rollers 385 and 386. Because of that, a buffer amount of the recording medium W between the treatment-liquid application apparatus 220 and the first inkjet printer 230 in FIG. 6.

Embodiment 1

Figure 2:
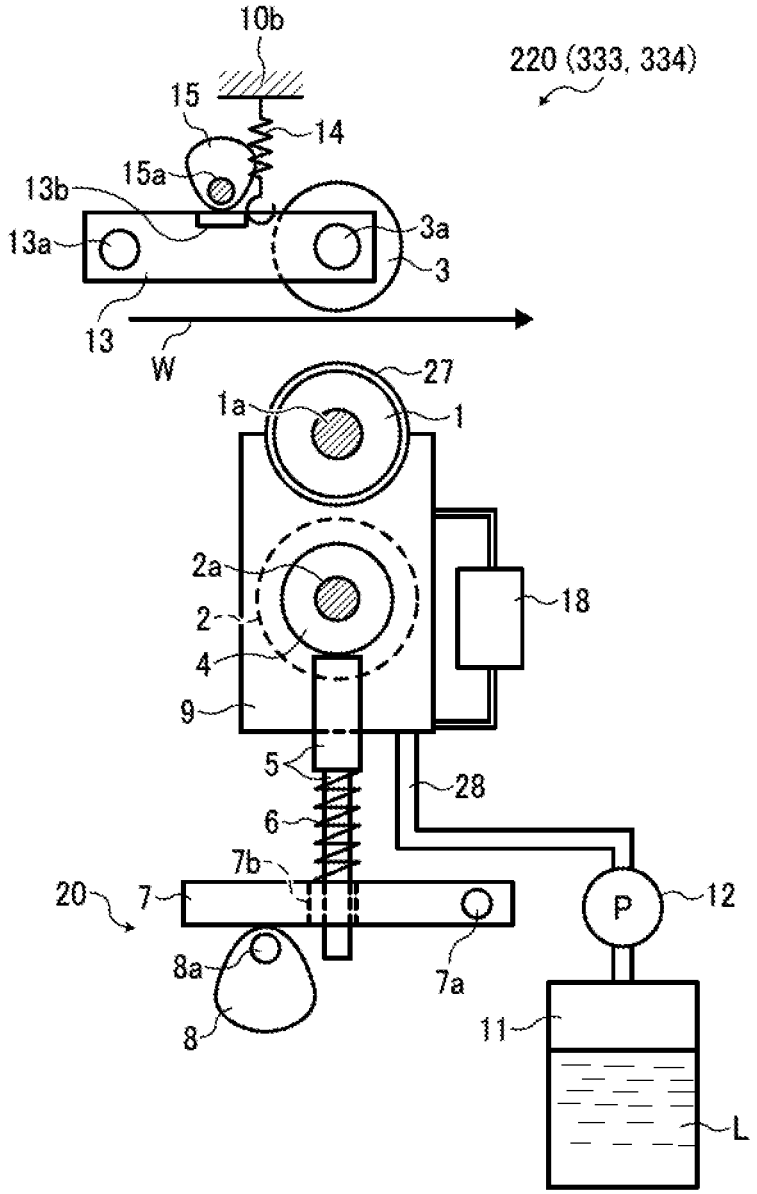
FIG. 2 is a schematic partially sectional side view of FIG. 1 when viewed from the side surface marked by arrow A.

Referring to FIGS. 1 to 5, the essential structure of the treatment-liquid application apparatus 220 according to Embodiment 1 of the present disclosure will now be explained. FIG. 1 is a schematic partially sectional front view of the essential parts of the treatment-liquid application apparatus according to Embodiment 1 when viewed from a front side, and FIG. 2 is a schematic partially sectional side view of FIG. 1 when viewed from the side surface marked by arrow A. FIGS. 1 and 2 illustrate a standby state before applying the treatment liquid, and the rear side application unit 333 and the front side application unit 334 shown in parentheses represent the essential structure of the treatment-liquid application apparatus 220 according to Embodiment 1. As shown in FIGS. 1 and 2, the essential structure of the treatment-liquid application apparatus 220 according to the present embodiment includes an application roller 1 that is covered over its peripheral surface by an elastic body 27 such as rubber, a squeeze roller 2 that is disposed below the application roller 1, a transfer roller 3 that is disposed above the application roller 1, and a supply pan 9. These three rollers, i.e., the application roller 1, the squeeze roller 2, and the transfer roller 3, are arranged approximately in the vertical direction as shown in FIG. 2. The transfer roller 3 may also be called a pressure roller.

The application roller 1 is disposed on the feed path of the long recording medium W, and functions as a rotary treatment-liquid applicator that applies the measured treatment liquid onto the recording medium W. The squeeze roller 2 is configured such that it can contact to and retract from the application roller 1, and functions as a rotary treatment-liquid supplier that scoops up the treatment liquid and supplies it to the application roller 1. The transfer roller 3 is configured such that it can contact to and retract from the application roller 1 via the recording medium W, and functions as a transfer rotator that transfers the measured treatment liquid of the application roller 1 to the recording medium W in a state of contact with the application roller 1.

The application roller 1 and the squeeze roller 2 are individually driven to rotate in a predetermined direction by a drive source such as a motor. The supply pan 9 functions as a supply liquid chamber that stores the treatment liquid L. The treatment liquid L is obtained by dissolving a treatment agent for enhancing the image quality, such as by preventing bleeding of the ink, suppressing show-through, assisting permeation, and the like.

If the squeeze roller 2 or the transfer roller 3 contacts the application roller 1 when the application roller 1 is not rotating, an elastic body 27 of the application roller 1 deforms slightly, and this may cause application unevenness of the treatment liquid L. Therefore, in the present embodiment, when the treatment liquid L is not being applied, the squeeze roller 2 and the transfer roller 3 are spaced apart from the application roller 1 so that they do not contact the application roller 1 as shown in FIGS. 1 and 2.

As shown in FIG. 1, in the roller longitudinal direction of the application roller 1, the squeeze roller 2, and the transfer roller 3, the configuration of these rollers at the left and right ends has an approximately left-right symmetrical shape with respect to a center line in the roller longitudinal direction. Therefore, hereinafter, the roller configuration of one end, for example the left side end, may be explained as a representative example. Each end of a shaft 2*a* of the squeeze roller 2 is rotatably supported by a roller support 4, which is a bearing member that is attached and fixed to a side frame of the supply pan 9. A holder support 5, which has a stepped shape in which the top is large and the bottom is narrow, is connected below the roller support 4.

Below the holder support 5, an arm 7 equipped with an arm support shaft 7*a* is disposed such that the arm 7 can pivot around the arm support shaft 7*a*. A long escape hole 7*b*, into which a lower part of the holder support 5 is inserted (meaning passed through the hole), is formed in the arm 7 so that the pivoting operation of the arm 7 is not obstructed. The arm support shafts 7*a* on the left and right side in FIG. 1 are rotatably supported by a left-right pair of body frames 10 of the treatment-liquid application apparatus. Because of that, a free end of the arm 7 on the opposite side of the arm support shaft 7*a* can pivot around the arm support shaft 7*a*.

A coiled push-up spring 6 (compression spring) is fitted in a slightly compressed state on the holder support 5 between a lower end of the upper part, which is a stepped part, of the holder support 5 and an upper surface of the arm 7. Meanwhile, a squeeze cam 8 equipped with a cam shaft 8*a* is disposed on the free end of each arm 7. Each squeeze cam 8 is in constant contact with the lower end of the arm 7 because the free end of each arm 7 is pressed by the elastic force of the push-up spring 6. The cam shafts 8*a* are rotatably supported by the body frames 10. The left and right cam shafts 8*a* are integrally connected. Further, the left and right squeeze cams 8 are driven to rotate at the same cam rotation angle by being connected to a cam drive motor serving as a squeeze cam drive source via a drive transmitter such as a gear provided on the cam shafts 8*a*.

As explained above, a contact load adjuster 20, which adjusts a contact load (nip load) of the application roller 1 on the squeeze roller 2, is mainly constituted by the roller supports 4, the holder supports 5, the push-up springs 6, the arms 7, the squeeze cams 8, and the cam drive motor. A mover that can contact/retract the squeeze roller to/from the application roller 1 has the same configuration as the contact load adjuster 20. In FIG. 1, the roller supports 4 on the left and right sides are supported via the holder supports 5 such that the free ends of the arms 7 can pivot around the arm support shafts 7*a* of the arms 7. Further, the squeeze cams 8 are in constant contact with the free ends of the arms 7 by the elastic force of the push-up springs 6, and the squeeze roller 2 contacts the application roller 1 by being pushed up by the rotation of the squeeze cams 8 in the vertically upward direction to contact the application roller 1 together with the supply pan 9.

Large diameter parts of the squeeze cams 8 contact the free ends of the arms 7 by the rotation of the squeeze cams 8, and therefore the arms 7 pivot in the clockwise direction in FIG. 2 around the arm support shafts 7*a*, and then the arms 7 compress the push-up springs 6 to change the compression length of the push-up springs 6. At this time, the spring load of the push-up springs 6 is transmitted to the shaft 2*a* of the squeeze roller 2 via the holder supports 5 and the roller supports 4. The squeeze roller 2 is then pushed up in the vertically upwards direction to contact the application roller 1, and therefore a nip is formed between the squeeze roller 2 and the application roller 1. According to this configuration including the contact load adjuster, the spring load of the push-up springs 6 is changed by the phase and rotation angle of the squeeze cams 8, and therefore an arbitrary pressing load (contact load) can be imparted.

As shown in FIGS. 1 and 2, the application roller 1 and the squeeze roller 2 are accommodated within the supply pan 9. The treatment liquid L is supplied from a tank 11 in which the treatment liquid L is stored into the supply pan 9 via a flexible tube 28 by driving a pump 12. Because of that, the squeeze roller 2 is partially immersed in the treatment liquid L inside the supply pan 9. The liquid level of the treatment liquid L within the supply pan 9 is monitored by a liquid level sensor 18. A controller controls the driving of the pump 12 based on a detection signal from the liquid level sensor 18 so that the liquid level within the supply pan 9 is maintained at a fixed level. By the above-described operation for supplying the treatment liquid L, a portion of the squeeze roller 2 is maintained in a state of constant immersion in the treatment liquid L even if the squeeze roller 2 is pushed up to the application roller 1 side.

As shown in FIG. 2, both ends of the transfer roller 3 are rotatably supported by the free ends of arms 13 via a shaft 3*a* of the transfer roller 3. An arm support shaft 13*a*, which is a base end of each arm 13, is rotatably supported by a top panel frame 10*b* fixed to the body frame 10. One end of a holder support 14 is attached between a shaft 3*a* support and an arm support shaft 13*a* of each arm 13. The other end of the holder support 14 is attached to the top panel frame 10*b*. The elastic force of the holder support 14 causes the arm 13 to have a habit of always pivoting in the counter clockwise direction around the arm support shaft 13*a*, and causes a transfer roller cam 15 to be explained later to constantly contact a cam abutment portion 13*b*.

An L-shaped cam abutment portion 13*b* is integrally formed on each arm 13 at approximately the same location where the one end of the holder support 14 is mounted. A transfer roller cam 15 equipped with a cam shaft 15*a* is disposed on the cam abutment portion 13*b* of each arm 13 so as to be in constant contact with the cam abutment portion 13*b*. The transfer roller cam 15 is constantly biased (meaning its momentum is increased) in the vertically upwards direction by the elastic force of the holder support 14, and therefore the transfer roller cam 15 is in constant contact with the cam abutment portion 13*b*. Each cam shaft 15*a* is rotatably supported on the body frame 10. The left and right cam shafts 15*a* are integrally connected. The left and right transfer roller cams 15 are driven to rotate at the same rotation angle by being connected to a transfer cam drive motor serving as a transfer cam drive source via a drive transmitter such as a gear provided on one of the cam shafts 15*a*.

As explained above, a mover for a transfer rotator that contacts/retracts the transfer roller 3 to/from the application roller 1 via the recording medium W is constituted mainly by the arms 13, the holder supports 14, the transfer roller cams 15, and the transfer cam drive motor.

The application roller 1 is constituted integrally with rotation shafts 1*a* that protrude from both end faces of the application roller 1. Bearings 17 that rotatably support the rotation shafts 1*a* of the application roller 1 are mounted on the rotation shafts 1*a*. Meanwhile, long holes 10*a* that extend in approximately the vertical/up-down direction (approximately the load direction) are formed near positions corresponding to the bearings 17 on the left and right body frames 10 shown in FIG. 1. The longer diameter (diameter in the vertical/up-down direction) of each long hole 10*a* is longer than the outer diameter of the bearing 17, and the shorter diameter (diameter in approximately the horizontal direction that is orthogonal to the vertical/up-down direction) of each long hole 10*a* is set to be approximately the same dimension as the outer diameter of the bearing 17. Because of that, the bearings 17 can be inserted into the long holes 10*a* such that they can slide in the vertical/up-down direction therein. Therefore, the application roller 1 can freely move in approximately the vertical/up-down direction via the bearings 17 mounted to the ends of the rotation shafts 1*a*, and the application roller 1 is restricted from moving in the horizontal direction.

The recording medium W is inserted between the application roller 1 and the transfer roller 3. When a Run signal serving as a command signal is input from the controller, the feed operation of the recording medium W is initiated by a feeding assembly (the outfeed roller 335) shown in FIG. 7. When the transfer roller cams 15 are driven to rotate, the transfer roller 3 contacts the application roller 1 via the arms 13 (the operation of this portion will be explained in detail below).

By the above configuration, the treatment liquid L is supplied to the nip between the rotating application roller 1 and squeeze roller 2, and therefore the treatment liquid L is measured. The treatment liquid L passes through the nip, and a thin treatment liquid layer is formed on the surface of the application roller 1. The amount of the treatment liquid layer can be adjusted by the load generated by the push-up springs 6, or in other words by the rotation angle of the squeeze cams 8. The recording medium W is pressed to the application roller 1 on which the thin treatment liquid layer has been formed on the surface thereof by the transfer roller 3, and therefore the treatment liquid L is transferred and applied onto the recording medium W.

As described above, in FIG. 1, the roller supports 4 on the left and right sides are supported via the holder supports 5 such that the free ends of the arms 7 can pivot around the arm support shafts 7*a* of the arms 7. Further, the squeeze cams 8 are in constant contact with the free ends of the arms 7 by the elastic force of the push-up springs 6, and the squeeze roller 2 contacts the application roller 1 by being pushed up by the rotation of the squeeze cams 8 in the vertically upwards direction to contact the application roller 1 together with the supply pan 9. As the squeeze cams 8 rotate, the squeeze cams 8 contact the free ends of the arms 7 from the small diameter parts to the large diameter parts of the squeeze cams 8, and therefore the arms 7 pivot in the clockwise direction in FIG. 2 around the arm support shafts 7*a* to compress the push-up springs 6. At this time, the spring load of the push-up springs 6 is transmitted to the shaft 2*a* of the squeeze roller 2 via the holder supports 5 and the roller supports 4. The squeeze roller 2 is then pushed up in the vertically upwards direction to contact the application roller 1, and therefore a nip is formed between the squeeze roller 2 and the application roller 1. According to this configuration, an arbitrary pressing load within a set range can be imparted via the spring load of the push-up springs 6 by the phase and rotation angle of the squeeze cams 8.

Figure 3:
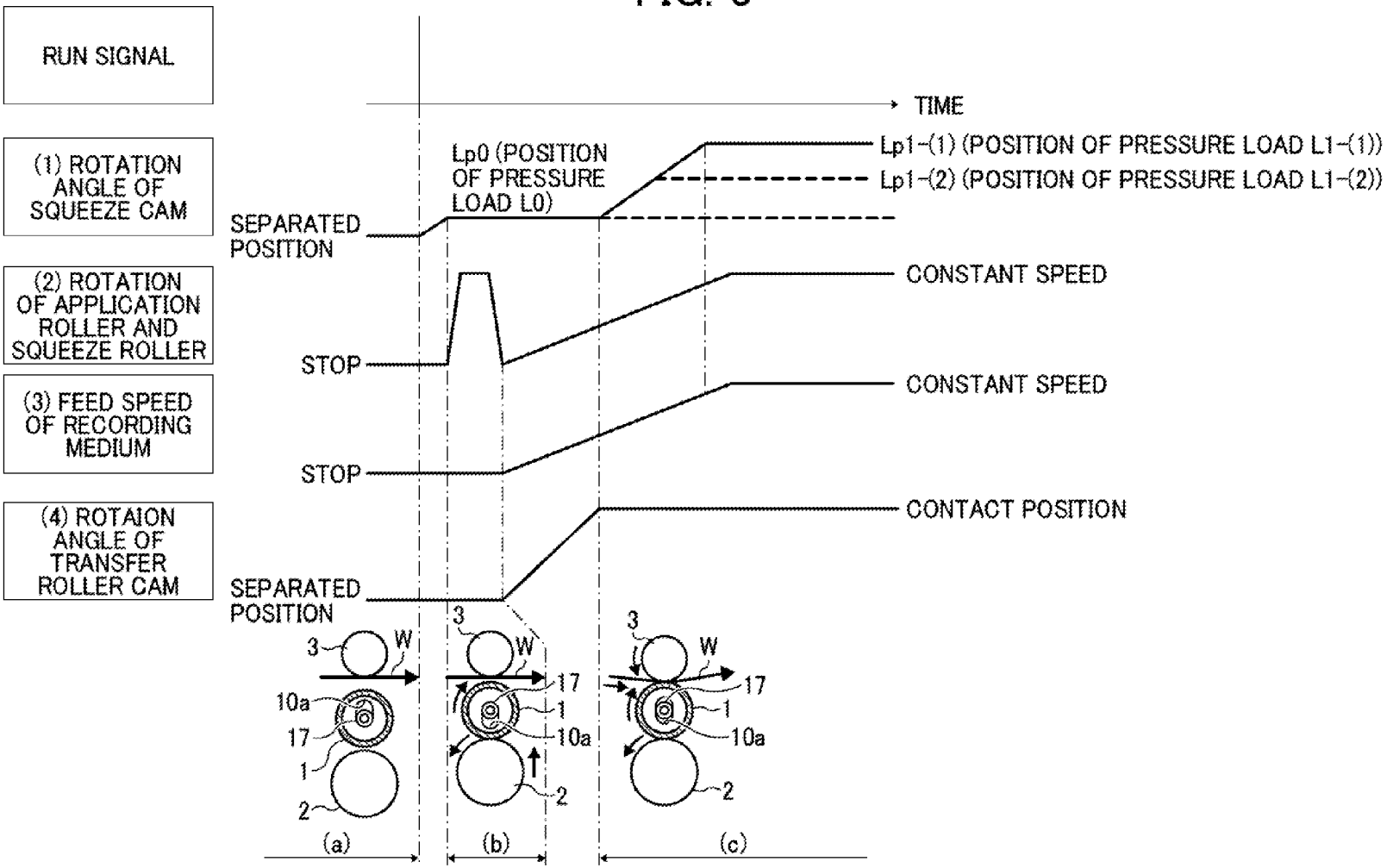
FIG. 3 illustrates timing charts and positional relationships between rollers for a shift of a squeeze cam rotation angle, a change in rotation of an application roller and a squeeze roller, a change in feed speed of a recording medium, and a shift of a transfer roller cam rotation angle.
Figure 4:
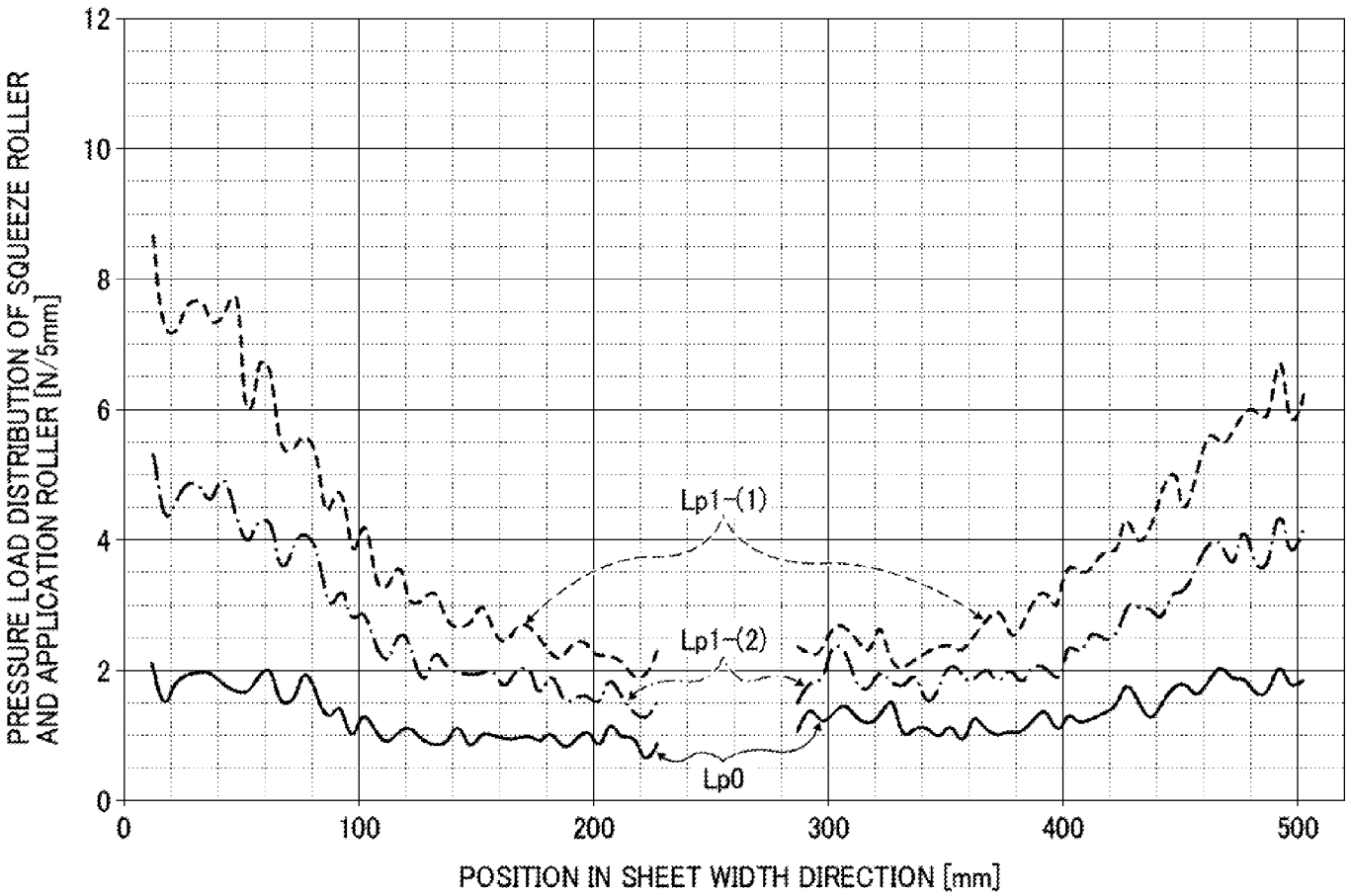
FIG. 4 is a graph illustrating a contact load distribution at positions in a sheet width direction between a squeeze roller and an application roller before transfer roller contact.
Figure 5:
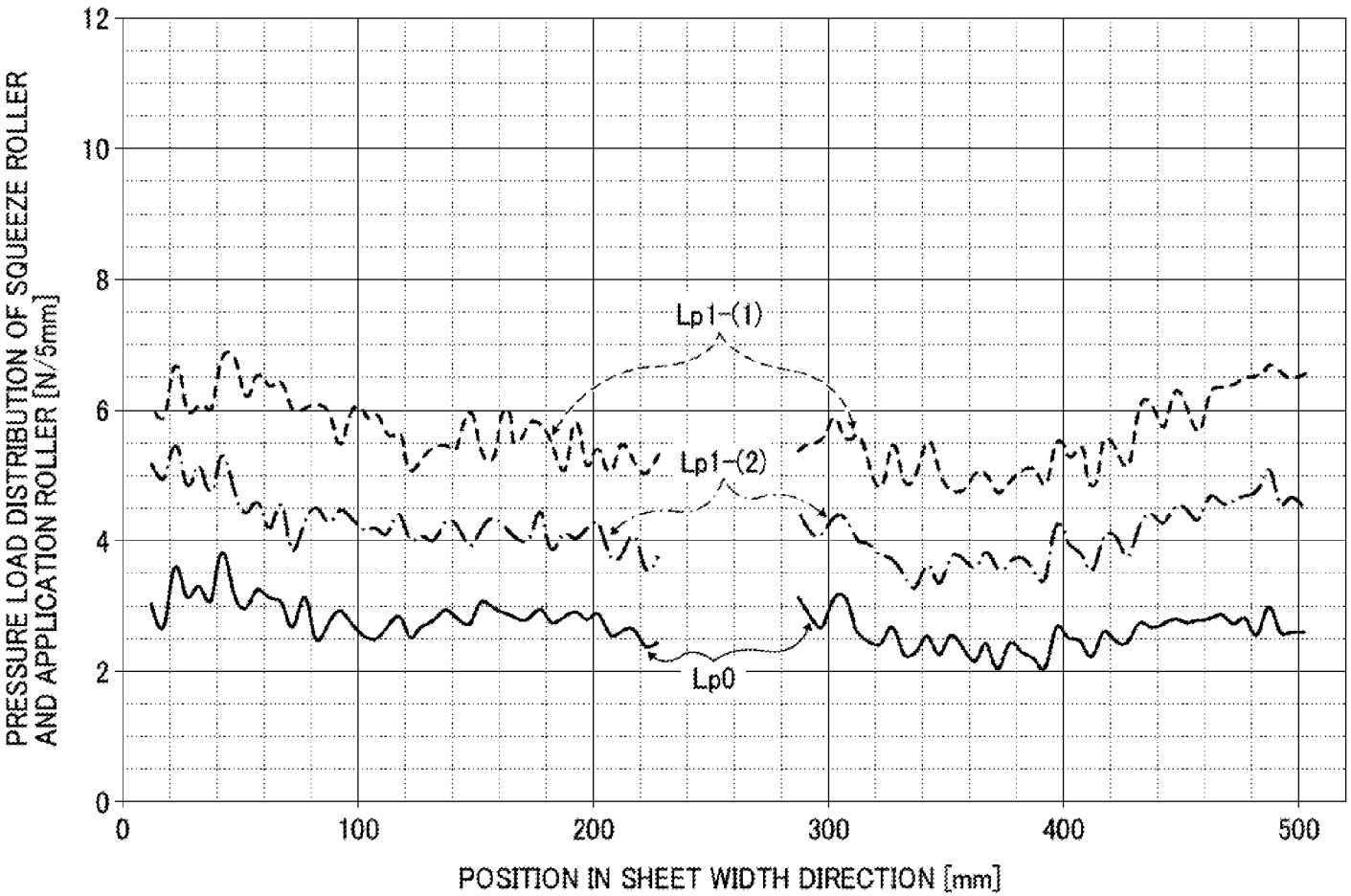
FIG. 5 is a graph illustrating a contact load distribution at positions in a sheet width direction between a squeeze roller and an application roller after transfer roller contact.

Next, the application operation of the treatment liquid L will be explained referring to FIGS. 3 to 5. FIG. 3 illustrates timing charts and positional relationships between the rollers in (1) to (4) in response to the Run signal for initiating the treatment liquid application operation. Regarding the timing charts, (1) illustrates a shift of the rotation angle of the squeeze cams 8, (2) illustrates a change in rotation of the application roller 1 and the squeeze roller 2, (3) illustrates a change in feed speed of the recording medium W, and (4) illustrates a shift of the rotation angle of the transfer roller cams 15. FIG. 4 is a graph illustrating a contact load distribution at positions in a sheet width direction between the squeeze roller and the application roller before transfer roller contact. FIG. 5 is a graph illustrating a contact load distribution at positions in a sheet width direction between the squeeze roller and the application roller after transfer roller contact. The horizontal axis in FIGS. 4 and 5 represents a sheet width direction position [mm], and the vertical axis represents a contact load distribution [N/5 mm] between the squeeze roller 2 and the application roller 1. The unit [N/5 mm] of the vertical axis is a contact load per 5 mm because the cells of the measuring instrument are notched every 5 mm. The sheet width direction position is also the position in the longitudinal direction of the rollers. FIG. 3(*a*) illustrates a standby state of the rollers before the treatment liquid L is applied (refer to FIGS. 1 and 2). As shown in FIG. 3(*a*), the bearings 17 on the ends of the application roller 1 contact the lower ends of the long holes 10*a* of the body frames 10 by their own weight, and the application roller 1, the squeeze roller 2, and the transfer roller 3 are all separated from each other. (1) The squeeze cams 8 are in a separated position, (2) the application roller 1 and the squeeze roller 2 are stopped, (3) the recording medium W is also stopped, and (4) the transfer roller cams 15 are in a separated position.

When the Run signal is input, the rollers enter the states/positions shown in FIG. 3(*b*). First, the squeeze cams 8 rotate, and thus the squeeze roller 2 is pushed in the vertically upwards direction. Because of that, the squeeze roller 2 contacts the application roller 1, and thus the application roller 1 is pushed up. The bearings 17 on the ends of the application roller 1 contact the top ends of the long holes 10*a*, and thus the application roller 1 is further pushed up. A contact load L0 between the squeeze roller 2 and the application roller 1 at this time is 118 N as a result of measurement by a load cell which is a load indicator.

The load balance in the roller longitudinal direction between the squeeze roller 2 and the application roller 1 at this time is a squeeze cam position Lp0 as shown by the solid line in FIG. 4, and this load can suppress the influence of bending of the squeeze roller 2 and the application roller 1 in the roller longitudinal direction. In the present embodiment, as a load that can suppress the influence of bending in the roller longitudinal direction, a contact load distribution difference (maximum value−minimum value) per unit length between the squeeze roller 2 and the application roller 1 is employed, and a target value thereof is 3 N/5 mm or less. In the present embodiment, the contact load distribution difference (maximum value−minimum value) per unit length between the squeeze roller 2 and the application roller 1 is 1.5 N/5 mm as shown by the solid line in FIG. 4 which represents an actual measurement value, and thus it is clearly less than the target value of 3 N/5 mm.

In this state, the application roller 1 and the squeeze roller 2 are rotated, and then the rotation is stopped after a prescribed amount of time has passed. Hereinafter, the operation that is carried out when the rotation of the application roller 1 and the squeeze roller 2 is stopped after a prescribed amount of time has passed will be referred to as the cleaning operation. That is to say, the treatment liquid L within the supply pan 9 is scooped up by the rotation of the squeeze roller 2 and contacts the surfaces of the application roller 1 and the squeeze roller 2. The treatment liquid L adheres to the surface of the elastic body 27 of the application roller 1 and volatile components within the treatment liquid L evaporate while the operation is stopped, which causes the viscosity of the treatment liquid L to increase. The cleaning operation is for removing this thickened liquid by mixing treatment liquid L in the supply pan 9 having a normal viscosity into the treatment liquid L having increased viscosity. The thickened treatment liquid L has a characteristic of redispersing when treatment liquid L of a normal viscosity is mixed therein.

The present embodiment has a function of changing the application amount of the treatment liquid L by adjusting the contact load between the squeeze roller 2 and the application roller 1 by the contact load adjuster 20 shown in FIGS. 1 and 2. In the present embodiment, the treatment liquid application amount setting value has the following three levels in accordance with the rotation angle/position of the squeeze cams 8: a small application amount of the treatment liquid L (high load setting), a medium application amount of the treatment liquid L (mid load setting), and a large application amount of the treatment liquid L (low load setting). In the case of the high load setting in which the application amount of the treatment liquid L is reduced or the mid load setting in which the application amount of the treatment liquid L is medium, the angle of the squeeze cams 8 is shifted from this state to adjust the contact force (contact load). In other words, in the present embodiment, the treatment liquid application amount is adjustable with the value of a contact load L1 imparted when the transfer roller 3 contacts the application roller 1 via the recording medium W. The contact load L1 is adjustable in multiple steps including the contact load L0.

In the case of the high load setting in which the application amount of the treatment liquid L is reduced, the rotation position of the squeeze cams 8 is shifted from Lp0 to Lp1-(1) as shown in (1) of FIG. 3. In the case of the mid load setting in which the application amount of the treatment liquid L is medium, the rotation position of the squeeze cams 8 is shifted from Lp0 to Lp1-(2). In the case of the low load setting in which the application amount of the treatment liquid L is increased, the rotation position of the squeeze cams 8 remains at Lp0 for executing the application operation of the treatment liquid L.

If the contact load L0 between the squeeze roller 2 and the application roller 1 is 50 N or less, a bound is generated between the squeeze roller 2 and the application roller 1 due to the influence of roller eccentricity between the squeeze roller 2 and the application roller 1, and thus the contact state during rotation becomes unstable. Therefore, the contact load L0 is prevented from decreasing to 50 N or less. Herein, if the squeeze cam position Lp0 is set to a squeeze cam position Lp1-(1) or Lp1-(2) similar to that during the printing operation, the transfer roller 3 becomes separated. Therefore, as shown by the squeeze cam positions Lp1-(1) and Lp1-(2) in FIG. 4, the load balance is affected by bending in the roller longitudinal direction of the squeeze roller 2 and the application roller 1, and thus the load balance becomes uneven. However, in FIG. 4, since the transfer roller 3 is in a separated state before contact, the above-described uneven load balance is prevented. In FIG. 3, once the cleaning operation has ended, (1) the rotation position of the squeeze cams 8 is squeeze cam position Lp0, (2) the application roller 1 and the squeeze roller 2 begin rotating (acceleration operation), (3) the recording medium W begins to be fed (acceleration operation), and (4) the transfer roller cams 15 begin rotating to the contact position.

Next, the transfer roller cams 15 rotate and reach a contact position where the transfer roller 3 contacts the application roller 1 via the recording medium W. Once the transfer roller cams 15 reach the contact position, as shown in FIG. 3(*c*), the bearings 17 on the ends of the application roller 1 are pushed down near the center of the long holes 10*a* of the body frames 10, and the support shifts from support at both ends by the bearings 17 to support across the entire longitudinal direction by the transfer roller 3. The load balance at positions in the sheet width direction between the squeeze roller 2 and the application roller 1 at the squeeze cam position Lp0 in the state after contact with the transfer roller 3 is 1.8 N/5 mm as shown by the solid line in FIG. 5, which is a uniform load balance in which bending at positions in the sheet width direction is suppressed.

FIG. 5 illustrates the load balance in the longitudinal direction when the rotation position of the squeeze cams 8 is Lp1-(1) and Lp1-(2). Similar to the case of the squeeze cam position Lp0, in FIG. 5, the load balance at positions in the sheet width direction is 2.2 N/5 mm, which is a uniform load balance, as shown by the rotation position Lp1-(1) of the squeeze cams 8 depicted with a broken line in FIG. 5 and the rotation position Lp1-(2) of the squeeze cams 8 depicted with a broken line in FIG. 5. Because of that, a uniform nip state can be secured at positions in the sheet width direction (roller longitudinal direction) between the squeeze roller 2 and the application roller 1 as shown by the rotation position Lp1-(1) and the rotation position Lp1-(2) of the squeeze cams 8 after contact with the transfer roller 3.

In the present embodiment, the settings of the treatment liquid application amount are divided into three levels as described above. However, the treatment liquid application amount can also be set without any relation to whether the contact load adjuster 20 is present or absent. Since the shifting of the rotation angle (rotation position) of the squeeze cams 8 to each treatment liquid application amount setting is completed during acceleration of the recording medium W in which printing is not executed, stable application characteristics can be obtained in the first inkjet printer 230 and the like without increasing waste paper (discarded paper). Further, in the present embodiment, as shown in FIG. 3, the shifting of the rotation angle (position) of the squeeze cams 8 is initiated after the transfer roller 3 has reached the contact position, but the present embodiment is not limited thereto. In other words, the same effects can be obtained as long as the shifting is initiated after the bearings 17 at the ends of the application roller 1 have separated from contact at the upper parts of the long holes 10*a* of the body frames 10 and the support at both ends by the bearings 17 has shifted to support across the entire longitudinal direction by the transfer roller 3.

As described above, according to at least one embodiment of the present disclosure, for example, the following effects can be achieved. First, according to the above-described configuration, in the contact/retraction state of the transfer roller 3, the contact load distribution between the application roller 1 and the squeeze roller 2 can be equalized so that a uniform application state can be obtained from immediately after the start of the treatment liquid application operation. Because of that, negative effects on feeding due to tension fluctuations of the recording medium can be eliminated, and the recording medium can be prevented from winding around the application roller 1 and the occurrence of jams of the recording medium due to excessive adherence of the treatment liquid can be prevented. Further, a treatment-liquid application apparatus capable of suppressing waste paper, reducing roller staining, and preventing unnecessary consumption of treatment liquid can be provided.

Second, the state in which the transfer roller 3 contacts the application roller 1 via the recording medium W occurs after the transfer roller 3 arrives at the contact position with the application roller 1 during printing or after the transfer roller 3 contacts the application roller 1 across the entire longitudinal direction thereof. Because of that, in the contact/retraction state of the transfer roller 3, the contact load distribution between the application roller 1 and the squeeze roller 2 can be equalized, and thus a uniform application state can be obtained from immediately after the start of the treatment liquid application operation.

Third, as shown in FIG. 3, an operation for adjusting the contact load L0 of the squeeze roller 2 on the application roller 1 to L0<L1 is completed during the acceleration operation of the recording medium. Because of that, a region of unstable application of the treatment liquid can be suppressed to a range of the recording medium in which no printing is carried out during acceleration of the recording medium, and this achieves an effect of reducing waste paper.

Fourth, when the contact load L0 is imparted, the contact load distribution difference, which is the difference between the maximum value and the minimum value of the contact load per unit length in the longitudinal direction between the application roller 1 and the squeeze roller 2, is 3 N/5 mm or less. Because of that, the contact load distribution between the application roller 1 and the squeeze roller 2 in a retracted state of the transfer roller 3 (before nip formation of the transfer roller 3) can be equalized, and thus a uniform application state can be obtained from immediately after the start of the treatment liquid application operation.

Fifth, the treatment liquid application amount is adjustable with the value of the contact load L1, and the contact load L1 is adjustable in multiple steps. Because of that, the treatment liquid application amount is adjustable evenly and in accordance with the use thereof.

Sixth, in a state before the transfer roller 3 contacts the application roller 1 via the recording medium, an operation is executed to contact the squeeze roller 2 to the application roller 1 and rotate the application roller 1 and the squeeze roller 2 before feeding the recording medium W. The contact load when executing this operation is also the contact load L0 which is the same as that in the state before the transfer roller 3 contacts the application roller 1 via the recording medium. Because of that, the contact load distribution between the application roller 1 and the squeeze roller 2 can be equalized even in, for example, the cleaning operation which is carried out during a retracted state of the transfer roller 3. Thus, a uniform application state can be obtained from immediately after the start of the treatment liquid application operation.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The advantages and effects described in the above-described embodiments and examples of the present disclosure are examples of effects obtained from the present invention. The advantages and effects obtained from the present invention are not limited to those described in the embodiments and examples of this disclosure.

What is claimed is:

1. A treatment-liquid application apparatus, comprising:

a rotary treatment-liquid applicator disposed on a feed path of a recording medium to apply a treatment liquid to the recording medium;

a rotary treatment-liquid supplier disposed below the rotary treatment-liquid applicator to contact and retract from the rotary treatment-liquid applicator, scoop up the treatment liquid, and supply the treatment liquid to the rotary treatment-liquid applicator;

a transfer rotator disposed above the rotary treatment-liquid applicator to contact and retract from the rotary treatment-liquid applicator via the recording medium and transfer the treatment liquid on the rotary treatment-liquid applicator to the recording medium in contact with the rotary treatment-liquid applicator; and a contact load adjuster to adjust a contact load of the rotary treatment-liquid supplier on the rotary treatment-liquid applicator, wherein, after feeding of the recording medium is initiated by contact between the rotary treatment-liquid applicator and the transfer rotator, an acceleration time until a feed speed of the recording medium reaches a constant speed during printing is set, wherein, before feeding of the recording medium is initiated, the rotary treatment-liquid supplier contacts the rotary treatment-liquid applicator and imparts a contact load L0, and wherein during an acceleration operation of the recording medium after feeding of the recording medium is initiated, the transfer rotator contacts the rotary treatment-liquid applicator via the recording medium and imparts a contact load L1, and the contact load adjuster adjusts the contact load L1 to be greater than the contact load L0.

2. The treatment-liquid application apparatus according to claim 1, wherein a state in which the transfer rotator contacts the rotary treatment-liquid applicator via the recording medium occurs after the transfer rotator arrives at a contact position with the rotary treatment liquid applicator during printing or after the transfer rotator contacts the rotary treatment-liquid applicator across an entire longitudinal direction thereof.

3. The treatment-liquid application apparatus according to claim 1, wherein the contact load adjuster completes an operation for adjusting the contact load L1 to be greater than the contact load L0 during the acceleration operation of the recording medium.

4. The treatment-liquid application apparatus according to claim 1, wherein when the contact load L0 is imparted, a contact load distribution difference, which is a difference between a maximum value and a minimum value of the contact load per unit length in the longitudinal direction between the rotary treatment-liquid applicator and the rotary treatment liquid supplier, is 3N /5mm or less.

5. The treatment-liquid application apparatus according to claim 1, wherein an application amount of the treatment liquid is adjustable with a value of the contact load L1, and the contact load L1 is adjustable in multiple steps.

6. The treatment-liquid application apparatus according to claim 1, wherein in a state before the transfer rotator contacts the rotary treatment-liquid applicator via the recording medium, an operation is executed to contact the rotary treatment-liquid supplier to the rotary treatment-liquid applicator and rotate the rotary treatment-liquid supplier and the rotary treatment-liquid applicator before feeding the recording medium, and the contact load in execution of the operation is also the contact load L0 which is the same as that in the state before the transfer rotator contacts the rotary treatment-liquid applicator via the recording medium.

7. An image forming system, comprising:

the treatment-liquid application apparatus according to claim 1 to apply the treatment liquid to the recording medium before formation of an image, and an inkjet recording apparatus disposed on a downstream side of the treatment-liquid application apparatus in the feed direction, to discharge ink droplets onto the recording medium on which the treatment liquid has been applied, to form an image.

* * * * *